US005488263A

United States Patent [19]

Takemura et al.

[11] Patent Number: 5,488,263

[45] Date of Patent: Jan. 30, 1996

[54] COLOR SELECTING ELECTRODE FOR CATHODE-RAY TUBE

[75] Inventors: Taketoshi Takemura; Makoto Sakuwa; Haruo Watanuki, all of Nagaokakyo, Japan

[73] Assignees: Mitsubishi Denki Kabushiki Kaisha; Sony Corporation, both of Tokyo, Japan

[21] Appl. No.: 264,293

[22] Filed: Jun. 23, 1994

[30] Foreign Application Priority Data

Feb. 17, 1994 [JP] Japan ..... 6-020277

[51] Int. Cl.[6] ..... H01J 29/80

[52] U.S. Cl. ..... 313/402; 313/404

[58] Field of Search ..... 313/402, 403, 313/404, 405, 407, 408

[56] References Cited

U.S. PATENT DOCUMENTS

| | | | |
|---|---|---|---|
| 4,291,253 | 9/1981 | Ohkoshi et al. | 313/403 |
| 4,333,034 | 6/1982 | Ohgoshi et al. | 313/407 |
| 4,495,437 | 6/1985 | Kume et al. | 313/403 |
| 4,504,764 | 3/1985 | Sakamoto et al. | 313/403 |
| 4,605,878 | 8/1986 | Saita et al. | 313/407 |
| 4,780,641 | 10/1988 | Hashiba et al. | 313/407 |
| 4,798,992 | 1/1989 | Ichigaya et al. | 313/407 |
| 5,111,107 | 5/1992 | Kume et al. | 313/405 |

FOREIGN PATENT DOCUMENTS

| | | |
|---|---|---|
| 50-68650 | 6/1975 | Japan . |
| 61-42838 | 3/1986 | Japan . |
| 2-276137 | 11/1990 | Japan . |

*Primary Examiner*—Sandra L. O'Shea
*Assistant Examiner*—Vip Patel
*Attorney, Agent, or Firm*—Burns, Doane, Swecker & Mathis

[57] ABSTRACT

A color selecting electrode for use in a cathode-ray tube is provided which includes a frame having a pair of opposed first supports and a pair of opposed second supports extending in a direction such as to cross the pair of first supports, and grid elements disposed on the pair of first supports at a fixed pitch and stretchedly bridging the pair of first supports, wherein the pair of second supports and the grid elements are, respectively, made of materials selected such that an average thermal expansion coefficient of the pair of second supports over a temperature range from 0° C. to 470° C. is equal to or lower than 85% of that of the grid elements over the same temperature range.

6 Claims, 1 Drawing Sheet

COLOR SELECTING ELECTRODE FOR CATHODE-RAY TUBE

BACKGROUND OF THE INVENTION

The present invention relates to color selecting electrodes for cathode-ray tube and, more particularly, to a color selecting electrode for cathode-ray tube which is prevented from deterioration of characteristics such as color deviation even used for a long time thereby assuring improved reliability.

It is known that color selecting electrodes for cathode-ray tube are classified into two types; one is the so-called shadow mask type and the other is the so-called aperture grille type.

The latter includes a frame having a pair of opposed first supports and a of opposed second supports extending as crossing the first supports, and grid elements disposed on the pair of first supports at a fixed pitch and stretchedly bridging the first supports. With such a color selecting electrode, color selection is made when an electron beam passes through a slit defined between adjacent grid elements.

A conventional frame for use in the aperture grille type electrode is formed by joining the first supports to the second supports by arc welding, the first and second supports being both made of a low carbon alloy steel, or the first supports being made of stainless steel SUS403 and the second support made of chromium molybdenum steel SCM415. The above-mentioned materials for the first supports are cold drawn, annealed and then formed into a predetermined shape, while the materials for the second supports are cold worked and formed into a predetermined shape. After welding, the frame is annealed to remove residual stress existing therein, machined at required portions thereof including portions on which the grid elements are to be stretchedly disposed, and further subjected to machining so as to withstand the tension of the grid elements.

The grid elements are formed by etching a steel sheet obtained by cold working a very low carbon steel to harden it as having a tensile strength of about 70 kg/mm$^2$ to about 80 kg/mm$^2$. A set of such grid elements is a so-called aperture grille assembly (hereinafter referred to as "aperture grille").

In turn, the aperture grille is subjected to seam weld to the pair of the first supports under pressurized conditions such that compressive stress works on the pair of second supports, or in other words the pair of first supports are made close to each other. When the pressurization against the frame is relieved, the restoring force of the frame produces tension on each grid element. The aperture grille in such a state will be hereinafter referred to as "stretched mask". Since tension is thus exerted on the grid elements, the aperture grille type electrode is capable of absorbing an expansion of the grid elements due to a rise in the temperature thereof caused by incidence of electron beam on the grid elements. The stretched mask is further subjected to heat processes including a bleckening (steam treatment, or oxidation in exothermic gas) at about 450° C. to about 470° C. for about 20 minutes and a glass sealing treatment at a temperature substantially equal to the temperature for bleckening, thereby forming a cathode-ray tube.

As described above, the process for manufacturing the conventional stretched mask is performed under severe conditions where the mask is exposed to high tensile stress and high temperatures. Specifically, each of the grid elements initially experiences at end portions thereof a tension of about 50 kg/mm$^2$ (hereinafter referred to as "initial tension"), and the frame also experiences a bending stress of about 10 kg/mm$^2$. Further, the stretched mask is subjected to a heat treatment at about 450° C. to about 470° C. for about 20 minutes. A tension at end portions of each grid element after the heat treatment (hereinafter referred to as "final tension") decreases because of a relaxation phenomenon associated with creep. As disclosed in, for example, Japanese Unexamined Patent Publication No. 249339/1987 at page 204 second column line 10 to third column line 9, efforts to enhance the durability against creep of an aperture grille are made such as addition of nitrogen to a very low carbon steel. However, the final tension becomes as small as about a half of the initial tension of about 50 kg/mm$^2$.

Further, Japanese Unexamined Patent Publication No. 276137/1990 discloses at page 1 left column lines 8 to 11 an art of mitigating relaxation wherein a metal member having a thermal expansion coefficient larger than that of resilient supports (second supports) is fixed only on the side opposite to the side on which stretched bridges of grid elements are disposed to reduce the tension which is generated on the grid elements during a heat process, thereby mitigating relaxation.

With regard to the shadow mask type electrode, on the other hand, there is disclosed in, for example, Japanese Unexamined Patent Publications Nos. 42838/1986 and 68650/1975, an art of alleviating a color deviation by making a shadow mask comprised of a material having a low thermal expansion coefficient. However, unlike the aperture grille type electrode having bridges stretchedly provided of grid elements, this type of electrode has a mask which is not stretched. Therefore, there is no disclosure on the relationship between the tension of the grid elements and the thermal expansion coefficient thereof.

With the conventional stretched mask, a significant decrease in the tension on the grid elements is inevitable due to relaxation thereof and, hence, it is impossible to keep a desired tension distribution of the mask stably under long-time use conditions. Therefore, the conventional mask involves a problem that degradation of color selecting characteristics thereof is likely with an occurrence of color deviation.

Further, the first supports of the frame is likely to expand depending on the use condition because of a rise in the temperature of the cathode-ray tube whereby grid elements in end portions of the aperture grille are possible to be moved outwardly. This results in a problem of color deviation.

It is, therefore, an object of the present invention to overcome the problem of degradation in color selecting characteristics such as causing the color deviation because of thermal deformation of the aperture grille and to provide a color selecting electrode of high performance for cathode-ray tube in which a decrease is minimized in the tension of grid elements when the aperture grille is subjected to a heat process to assure a stabilized tension.

Another object of the present invention is to provide a color selecting electrode of high performance for cathode-ray tube which is substantially free from the color deviation due to deflection of the grid elements in the horizontal direction (the direction orthogonal to the direction in which the grid elements extend).

Yet another object of the present invention is to provide a color selecting electrode wherein grid elements having a low thermal expansion coefficient are used to reduce thermal expansion thereof in their stretching direction, so that the initial tension on end portions of each grid element can be set low enough to reduce relaxation thereby obtaining a desired tension stably even after the required heat process.

SUMMARY OF THE INVENTION

According to one aspect of the present invention, there is provided a color selecting electrode for use in a cathode-ray tube, comprising a frame having a pair of opposed first supports and a pair of opposed second supports extending in a direction such as to cross the pair of first supports, and grid elements arranged on the pair of first supports at a fixed pitch and stretchedly bridging the pair of first supports, wherein the pair of second supports and the grid elements are, respectively, made of materials selected such that an average thermal expansion coefficient of the pair of second supports over a temperature range from 0° C. to 470° C. (in other words, the mean coefficient of thermal expansion from 0° C. to 470° C.) is equal to or lower than 85% of that of the grid elements over the same temperature range.

Preferably, the pair of second supports and the grid elements are, respectively, made of materials selected such that the average thermal expansion coefficient of the pair of second supports is equal to or lower than 70% of that of the grid elements. By virtue of this feature, the tension on the grid elements during a heat process becomes sufficiently small thereby further decreasing a relaxation value to about a half of the case where the average thermal expansion coefficient of the pair of second supports is 85% of that of the grid elements. This assures enhanced stability in workability and in long-time use.

Further, preferably, the pair of first supports are made of a material having an average thermal expansion coefficient of 6 μm/m/° C. or lower over a temperature range from 0° C. to 100° C. so as to decrease the expansion thereof in the horizontal direction (the direction orthogonal to the direction in which the grid elements extend), whereby grid elements in end portions of the aperture grille will outwardly move little to alleviate the color deviation due to transverse move thereof. In addition, the relaxation of the grid elements is substantially decreased while deformation thereof is inhibited in both longitudinal and transverse directions, resulting in a color selecting electrode of very high performance.

According to another aspect of the present invention, there is provided a color selecting electrode for use in a cathode-ray tube, comprising a frame having a pair of opposed first supports and a pair of opposed second supports extending in a direction such as to cross the pair of first supports, and grid elements disposed on the pair of first supports at a fixed pitch and stretchedly bridging the pair of first supports, wherein the pair of first supports of the frame are made of a material having an average thermal expansion coefficient of 6 μm/m/° C. or lower over a temperature range from 0° C. to 100° C.

According to yet another aspect of the present invention, there is provided a color selecting electrode for use in a cathode-ray tube, comprising a frame having a pair of opposed first supports and a pair of opposed second supports extending in a direction such as to cross the pair of first supports, and grid elements disposed on the pair of first supports at a fixed pitch and stretchedly bridging the pair of first supports, wherein the grid elements are made of a material having an average thermal expansion coefficient of 6 μm/m/° C. or lower over a temperature range from 0° C. to 100° C.

DETAILED DESCRIPTION

Figure 1:
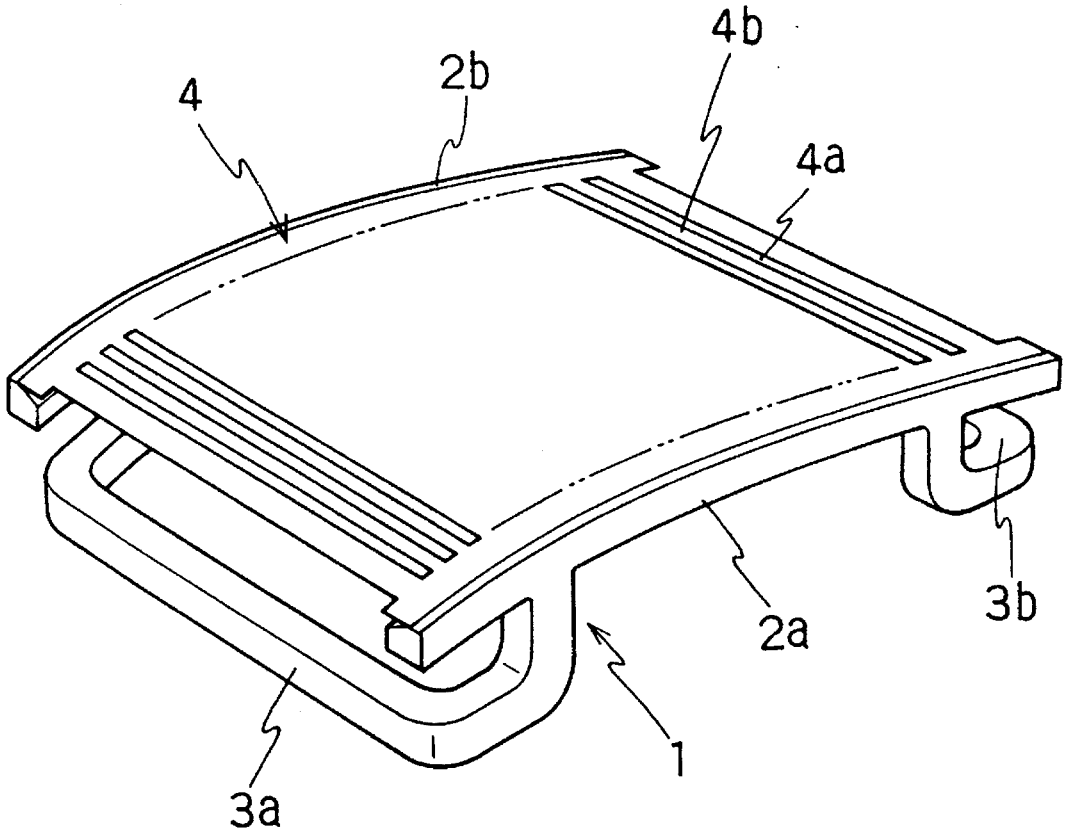
FIG. 1 is a perspective view of one embodiment of a color selecting electrode for cathode-ray tube according to the present invention.

In the present invention when the average thermal expansion coefficient of the second supports of the frame over a temperature range from 0° C. to 470° C. is set equal to or lower than 85% of that of the grid elements (for example, in the case where the grid elements are made of a nitrogen-containing low carbon steel and the second supports made of 13Cr or 18Cr stainless steel), the tension on the aperture grille of the stretched mask during the heat process is equal to or lower than 85% of that on the conventional aperture grille during the same heat process.

With respect to a steady state creep, a relaxation value is estimated in the following manner. Assume creep rate parameter P and stress σ be linearly represented by the following equations (1) and (2), respectively.

$$\log \theta = -0.0850P + 3.90 \quad (1)$$

$$P = 1.8T(20 - \log r) \times 10^{-3} \quad (2)$$

where θ is a stress (kg/mm$^2$), T a temperature (°K.), and, r a creep rate (%/hr).

Norton's expression can be represented:

$$d\epsilon/dt = C_\theta{}^n \quad (3)$$

where ε is a creep strain (dimensionless) and t is time.

Then, if T=470+273 (°K.), C and n can be determined from equation (3) to be; C=4.93×10$^{-17}$, and n=8.80.

From the above, if the initial stress be $\theta_o$, then stress θ at time t is found to be:

$$\sigma = \frac{\sigma_0}{\{1 + (n-1)\,\sigma_0^{(n-1)} ECt\}^{1/(n-1)}} \quad (4)$$

where E represents Young's modulus (kg/mm$^2$).

Where Young's modulus of the subject aperture grille is 20,000 kg/mm$^2$, t=0.5 hr, and $\theta_o$=50, 50×0.85, 50×0.7 kg/mm$^2$, θ is found to be 29.1 kg/mm$^2$, 28.9 kg/mm$^2$, 28.3 kg/mm$^2$ corresponding to the values of initial stress $\theta_o$. Therefore, the corresponding relaxation values ($\theta_o$−θ) are 20.9 kg/mm$^2$, 13.6 kg/mm$^2$ and 6.7 kg/mm$^2$, respectively.

Practically, the stress on the aperture grille increases since the frame is widened outwardly so as to balance decreasing stress of the second supports and, hence, a component of creep with a constant stress is added to an utter relaxation with a constant total strain. In addition thereto there are a localized yield in portions of the first supports which the aperture grille is welded to and transient creep of the aperture grille. However, since the material of the aperture grille has been subjected to cold working assuring a large working ratio, the influence of the transient creep is considered to be relatively small.

Although various factors as well as the steady state creep of the aperture grille are related to the relaxation of the aperture grille, in general even if the initial tension decreases by 15%, the tension attained after the heat treatment varies by 0.7% ((29.1−28.9)/29.1) only and, hence, the relaxation is reduced to about ⅔.

Where the plastic strain (creep) associated with the relaxation is large, there conspicuously occur phenomena including torsion of each grid element, resulting in an aperture grille having unevenly spaced grid elements. Hence, a large decrease in relaxation obtained by decreasing the initial tension also brings a large advantageous effect on the evenness of apertures of the aperture grille.

The aforementioned effects will be achieved if the average thermal expansion coefficient of the second supports over the temperature range from 0° C. to 470° C. is lower than that of the grid elements over the same temperature range. If the average thermal expansion coefficient of the second supports is equal to 85% of that of the grid elements, the relaxation decreases to about ⅔ of that of the conventional stretched mask to bring a significant effect. Therefore, the average thermal expansion coefficient of the second supports is preferably lower than 85% of that of the grid elements.

Further, if the respective materials of the second supports and grid elements are selected such that the average thermal expansion coefficient of the second supports over the temperature range from 0° C. to 470° C. is equal to or lower than 70% of that of the grid elements over the same temperature range, the tension attained after the heat process varies by 2.7% ((29.1–28.3)/29.1) only and the relaxation is decreased by about 68%, namely, it is decreased to about ⅓ of that of the conventional stretched mask, more advantageously than the above.

In the conventional electrode in which the initial stress of the aperture grille is reduced by half, the horizontal stress distribution of the aperture grille changes complicatedly, presenting a problem of stability in workability and against long-time use. According to the present invention, by contrast, the relaxation is substantially decreased and, hence, the stability of the aperture grille in workability and against long-time use is enhanced. This results in a color selecting electrode of high reliability.

With the conventional color selecting electrode, when the first supports of the frame is expanded due to a rise in its temperature under the use conditions of a cathode-ray tube, there arises a problem that grid elements in lateral end portions of the aperture grille tend to be outwardly moved by several tens micrometers or more thereby causing a color deviation. However, if a material is used for the first supports of the frame such that the average thermal expansion coefficient of the first supports over the temperature range from 0° C. to 100° C. is equal to or lower than 6 μm/m/° C. (for example, Invar or 42 alloy), since such a thermal expansion coefficient is half the thermal expansion coefficient of the first supports of the conventional frame, the extent of outward move of the grid elements in end portions of the aperture grille is also half of that of the conventional ones. This leads to few occurrences of the color deviation problem.

If the average thermal expansion coefficient of the first supports is lower than that of the conventional one, or about 12 μm/m/° C., an advantageous effect is achieved to some extent. Visual observation on the move of grid elements which causes the color deviation revealed that a deflection of 5 μm or smaller hardly affected the visibility of color. If the present color selecting electrode is used in, for example, a standard 17-in. cathode-ray tube, the length of the first supports is about 326 min. With the average thermal expansion coefficient of the first supports of such an electrode being set to 6 μm/m/° C. or lower, a rise in temperature by 5° C. would bring a move of 326 mm$\times$0.5$\times$6$\times10^{-6}\times$5=4.89 μm on grid elements in end portions of the aperture grille since the length of the first supports on one side is 326 mm$\times$½. This value of move falls within the range that will not affect the visibility of color, so that the problem of color deviation due to transversal move of the grid elements can be overcome.

The aperture grille type electrode is characterized in that even if there is a rise in temperature in a localized portion of the aperture grille due to local irradiation of electron beam against such a localized portion, the thermal expansion of the grid elements is absorbed by converting it into elastic strain by virtue of the tension of the grid elements. Let an absorbable temperature difference be ΔT (° C.), thermal expansion coefficient be α, and Young's modulus and stress be E and θ, respectively, the following relationship is held:

$$\theta=\alpha\cdot\Delta T\cdot E \tag{5}$$

Accordingly, the tension needed for absorbing a thermal expansion of the aperture grille is reduced by about half if the thermal expansion coefficient α thereof is reduced by about half. In other words, by replacing the conventionally used nitrogen-containing carbon steel with a material of low thermal expansion coefficient, for example, 42 alloy for the aperture grille the value θ can be reduced to ½ or smaller as compared with that of the conventional aperture grille even if the value E decreased by about 10% is not taken into consideration since the thermal expansion coefficient of the 42 alloy is equal to or lower than ½ of that of the nitrogen-containing carbon steel. Hence, the final tension required is reduced to about ½ with the initial tension also reduced to about ½. This leads to an easy operation for stretchedly bridging the grid elements, decreased relaxation by virtue of reduced initial tension, and further stabilized tension on the grid elements. Accordingly, selecting the material for the aperture grille as having an average thermal expansion coefficient of 6 μm/m/° C. or lower over the temperature range from 0° C. to 100° C. results in a color selecting electrode in which the expansion of grid elements due to local heating by electron beam is capable of being absorbed thereby solving the problem of degraded display characteristics such as color deviation.

To be described in detail with reference to the drawing is the color selecting electrode for cathode-ray tube and manufacturing method thereof according to the present invention.

FIG. 1 is a perspective view of one embodiment of the color selecting electrode for cathode-ray tube according to the present invention. In FIG. 1 numeral 1 denotes a frame of the color selecting electrode which includes a pair of opposed first supports 2*a* and 2*b* and a pair of opposed second supports 3*a* and 3*b* extending in a direction such as to cross the first supports 2*a* and 2*b* and fixed thereto. An aperture grille 4 stretchedly bridges the pair of first supports 2*a* and 2*b* on one side thereof. The aperture grille 4 includes slits 4*a* formed at a fixed pitch by etching a steel sheet blank such as made of austenitic stainless steel, austenitic heat-resisting steel or nitrogen-containing very low carbon steel and a multiplicity of grid elements 4*b* in the form of ribbon element, the grid elements being formed of retained portions of the steel sheet blank other than the slits 4*a* and stretchedly disposed at a fixed pitch.

The color selecting electrode for cathode-ray tube of the present invention is characterized in that the second supports 3*a* and 3*b* (which extend parallel to the grid elements 4*b*) as a component of the frame 1 and the grid elements 4*b* are, respectively, made of materials selected such that the average thermal expansion coefficient of the second supports 3*a* and 3*b* over the temperature range from 0° C. to 470° C. is equal to or lower than 85% preferably 70% of that of the grid elements over the same temperature range. The reason why the average thermal expansion coefficient over the temperature range from 0° to 470° C. is herein considered is that the thermal expansion of the two components when subjected to heat processes (bleckening is and glass sealing treatment) is concerned. On the other hand, the thermal expansion of the present electrode in operation is due to local heating and the average heating temperature is considered to be 100° C. or below and, hence, the thermal expansion coefficient over the temperature range from 0° C. to 100° C. is concerned when the electrode is driven. Examples of the material for the grid elements such as to satisfy such a relationship include austenitic stainless steels (having an average thermal expansion coefficient of about 18 μm/m/° C. over the temperature range from 0° to 470° C.) such as SUS301, SUS302, SUS303, SUS304, SUS309, SUS310, SUS316, SUS317, SUS321 and SUS347, austenitic heat-resisting steels (having an average thermal expansion coefficient of about 17 μm/m/° C. over the same temperature range as above) such as SUH31, SUH35, SUH36, SUH37, SUH38, SUH309, SUH310, SUH330, SUH660 and SUH661, and nitrogen-containing carbon steels (having an average thermal expansion coefficient of about 14.1 μm/m/° C. over the same temperature range as above). Examples of the material for the second supports 3*a* and 3*b* such as to satisfy the required relationship include carbon steels such as S25C, chromium molybdenum steels such as SCM415, low carbon alloy steels (having an average thermal expansion coefficient of about 12 μm/m/° C. over the same temperature range as above) such as SM433, SCr420, SNC236 and SNCM415, and 13Cr or 18Cr stainless steel (having an average thermal expansion coefficient of about 11 μm/m/° C. over the same temperature range as above). The use of such materials respectively for the grid elements and the second supports makes it possible to set the average thermal expansion coefficient of the second supports over the temperature range from 0° C. to 470° C. to assume 80% to 70% of that of the grid elements.

Alternative examples of the material for the grid elements include very low carbon steels such as nitrogen-containing very low carbon steel and cold rolled steel plate SPCC, and chromium molybdenum steels such as SCM415 and Fe-2.25Cr-lMo. Note that the average thermal expansion coefficient of very low carbon steels having a carbon content of 0.06% over the temperature range from 0° C. to 470° C. is about 14.1 μm/m/° C. Alternative examples of the material for the second supports 3*a* and 3*b* include Fe—Ni alloys having an Ni content of 31 to 47 atomic percent such as Invar and 42 alloy (having an average thermal expansion coefficient of about 7.5 μm/m/° C. over the temperature range as above). The combination of such materials for the grid elements and second supports makes it possible to set the average thermal expansion coefficient of the second supports over the temperature range from 0° C. to 470° C. to assume about 70% to about 50% of that of the grid elements.

Another feature of the present invention resides in that the first supports 2*a* and 2*b* (which extend in a direction such as to cross the grid elements 4*b*) are made of a material selected as having an average thermal expansion coefficient of 6 μm/m/° C. or lower over the temperature range from 0° C. to 100° C. Selection of a material having such a low thermal expansion coefficient for the first supports 2*a* and 2*b* allows grid elements in end portions of the aperture grille to be prevented from outwardly moved thereby alleviating the color deviation. Examples of the material having such a low thermal expansion coefficient include Fe—Ni alloys (containing Ni in an amount of 31% to 47% by weight) such as Invar (Fe-36Ni having an average thermal expansion coefficient of about 1.5 μm/m/° C. over the temperature range from 0° C. to 100° C.) and 42 alloy (Fe-42Ni having an average thermal expansion coefficient of about 5.0 μm/m/° C. over the same temperature range as above), Super Invar (Fe-32Ni-5Co), and Stainless Invar (Fe-54Co-9.5Cr). Among these, Invar is preferable because of its low thermal expansion coefficient. Specifically, when Invar is quenched from, for example, 830° C. the average thermal expansion coefficient thereof is lowered to 0.64 μm/m/° C., or when it is quenched from the same temperature as above and then tempered, the average thermal expansion coefficient thereof is as small as 1.02 μm/m/° C., or when it is annealed at 830° C. and cooled down to room temperature in 19 hours, the average thermal expansion coefficient thereof is as small as 2.01 μm/m/° C.

The selection of the low thermal expansion coefficient material for the first supports 2*a* and 2*b* can be made for alleviating the color deviation either in view of its relationship with the materials selected for the second supports 3*a* and 3*b* and grid elements 4*b* or independently of such materials.

Yet another feature of the present invention resides in that the grid elements 4*b* is made of a material selected as having an average thermal expansion coefficient of 6 μm/m/° C. or lower over the temperature range from 0° C. to 100° C. Selection of such a low thermal expansion coefficient material for the grid elements 4*b* allows the thermal expansion of each grid element to be absorbed by converting it into elastic strain because of the tension thereon even when there is a rise in temperature in a localized portion of the aperture grille due to local irradiation of electron beam against the grille. Examples of the material having such a thermal expansion coefficient for the grid elements include Fe—Ni alloys such as Invar and 42 alloy, Super Invar, and Stainless Invar which are aforementioned as the materials having an average thermal expansion coefficient of 6 μm/m/° C. or lower over the temperature range from 0° C. to 100° C. for the first supports.

If Invar for example is used for the grid elements 4*b*, they can be stretched with the initial tension set at ⅙ of that required for grid elements of nitrogen-containing low carbon steel. Therefore, although there may be some cases where the tension is raised to about ½ of that required for the grid elements of nitrogen-containing very low carbon steel during the heat process, the operation for welding the aperture grille to the frame is facilitated while the relaxation is significantly decreased.

It should be noted that if the grid elements are made of 42 alloy instead of Invar and stretched with the initial tension thereof set at about ½ of that required for the grid elements of nitrogen-containing very low carbon steel while the second supports are made of a material having an average thermal expansion coefficient of about 12 μm/m/° C. over the temperature range from 0° C. to 470° C., the tension on the aperture grille is raised up to about a value required for the aperture grille made of nitrogen-containing very low carbon steel. Therefore, when 42 alloy is used for the aperture grille, the second supports need to be made of Invar or 42 alloy, whereby a low tension of the aperture grille is maintained even at an elevated temperature and a thermal expansion due to a rise in temperature which will occur in use conditions can be compensated for by such low tension. Specifically, where the second supports are made of Invar or 42 alloy while the aperture grille made of Invar, the initial tension on the aperture grille can be set to ⅙ or lower as compared with the case of nitrogen-containing very low carbon steel. Alternatively, where the aperture grille is made of 42 alloy while the second supports made of the material as above, the initial tension on the aperture grille can be set to about ½ as compared with the case of nitrogen-containing very low carbon steel used for the aperture grille. Further, the tension on the aperture grille of the present invention will not be raised even by a heat process, so that the relaxation of the aperture grille can be reduced thereby assuring a stabilized tension for the aperture grille.

The following Table 1 shows respective average thermal expansion coefficients of the aforementioned principal materials over the temperature ranges from 0° C. to 100° C. and from 0° C. to 470° C. Note that each average thermal expansion coefficient over the temperature range from 0° C. to 470° C. is estimated by extrapolating a thermal expansion coefficient over the temperature range from 0° C. to 300° C. and that over the temperature range from 0° C. to 500° C.

TABLE 1

| Material | Average thermal expansion coefficient (μm/m/°C.) | |
|---|---|---|
| | 0° C. to 100° C. | 0° C. to 470° C. |
| Low carbon steel (nitrogen-containing very low carbon steel) | 12.6 | 14.1 |
| Fe—1Cr—0.2Mo | 11.2 | 12.2 |
| Fe—12Cr(SUS403) | 9.9 | 11.1 |
| Fe—18Cr(SUS430) | 9.0 | 11.0 |
| 18Cr—8Ni | 17.3 | 18.2 |
| 25Cr—20Ni | 14.4 | 16.7 |
| Fe—31Ni | 6.0 | 8.0 |
| Fe—36Ni (Invar) | 1.5 | 7.5 |
| Fe—42Ni (42 alloy) | 5.0 | 7.5 |
| Fe—47Ni | 8.0 | 8.0 |
| Super Invar | ±0.1 | 7.5 |
| Stainless Invar | ±0.1 | 7.5 |

As described above, the aperture grille type color selecting electrode is adapted to exert a tension on its aperture grille and convert a thermal expansion of the aperture grille into an elastic strain by virtue of such a tension. Accordingly, a stress is produced in the frame as the reaction of the tension on the aperture grille. Hence, it is desired that the frame, especially the second supports withstand a yield stress (0.2% proof stress) of about 50 kg/mm$^2$ or higher so as not to yield by compression or creep by a later heat process such as blackening or glass sealing. Although the first supports do not receive such a strong compression force as the second supports do, it is desired that the first supports have a tensile strength of 50 kg/mm$^2$ or higher since the stress due to the tension of the grid elements is exerted on the first supports. For this reason, the materials for the frame is subjected to a strengthening process such as cold working, quenching and tempering. Description is then made on a method for manufacturing the color selecting electrode for cathode-ray tube with primary emphasis on such a (strengthening) heat treatment.

In the method for manufacturing the color selecting electrode for cathode-ray tube the frame 1 is formed by arc welding a pair of opposed first supports 2*a* and 2*b* to a pair of opposed second supports 3*a* and 3*b* extending in a direction such as to cross the pair of first supports 2*a* and 2*b* and then annealing these supports welded together for eliminating the residual stress existing therein. In turn, portions of the frame from which the grid elements are to stretchedly bridge are machined, and the aperture grille in which each slit 4*a* is defined between adjacent grid elements by etching is made to stretchedly bridge the portions thus machine worked. The aperture grille is welded to the frame so pressurized as to give the second supports 3*a* and 3*b* a compression stress of usually several kg/mm$^2$. When the pressurization is relieved, the restoring force of the frame brings a tension on each grid element. The resulting stretched mask is then subjected to heat processes at 450° C. to 470° C. for blackening and glass sealing to complete the color selecting electrode.

In this manufacturing method, the first supports are made of a material which is finally recrystalization annealed to have a yield stress of slightly smaller than 30 kg/mm$^2$. The second supports are cold worked to have a yield stress of 50 kg/mm$^2$ or higher.

When Invar or 42 alloy is used for the first or second supports, the formation of the first or second supports should be based on cold working.

Materials such as chromium molybdenum steel SCM415 and martensitic stainless steel SUS403 can also be strengthened by quenching and tempering.

SUS403 should be quenched and tempered under the following conditions. Although the quenching temperature for SUS403 is desirably 950° C. to 980° C., where a low carbon chromium molybdenum steel is used for the other supports, SUS403 is quenched by heating at 900° C. to 930° C. for about 30 minutes and then oil cooling so as to allow existance of a small amount of free ferrite since the desirable quenching temperature of the low carbon chromium molybdenum steel, i.e., 850° C. to 900° C. has to be taken into consideration.

SUS403 should be tempered at a temperature higher than 470° C. at which the heat process, or glass sealing, will be performed, since if it is tempered at 470° C. or below, a tempering reaction will occur during the heat process to cause a change in size thereby degrading the stability in the shape or size of the aperture grille.

When this material is tempered at about 500° C., secondary hardening occurs due to precipitation of fine particles of carbide, resulting in a decrease in the impact strength and corrosion resistance thereof. Hence, the tempering temperature for such a material is preferably 600° C. or higher. However, if the tempering temperature is too high, the yield stress and creep resistance of the material decrease. Hence, the tempering temperature is preferably 700° C. or below.

Accordingly, the tempering temperature for SUS403 is preferably within the range from 600° C. to 700° C., and the material is kept at such a temperature for about an hour. In general rapid cooling is preferable for tempering. In the present method, however, slow cooling (in furnace down to a temperature just under 400° C.) is desired so as to assure the dimensional stability. Thus, the material is assured of its having a yield stress of 50 kg/mm$^2$ to 70 kg/mm$^2$.

Where cold working is conducted on SUS403 for the second supports, it is desired to attain a working ratio such as to assure the aforementioned yield stress. Although it is desired to conduct annealing to eliminate an excessive internal stress produced by cold working, annealing at a temperature higher than the recrystalization temperature (about 550° C.) will nullify the effect of work hardening. On the other hand, annealing at 470° C. or below will cause the crystallographic structure, stress distribution, outward shape and size of the material to change. Therefore, the annealing temperature for eliminating stress is desirably within a relatively restricted range from 500° C. to 530° C. It is sufficient to heat the material at such a temperature for about an hour. This annealing might be more effective for eliminating stress when conducted after welding of the second supports to the first supports and before welding of the grid elements to the frame.

Such a work hardening treatment will assure a yield stress of 50 kg/mm$^2$ to 70 kg/mm$^2$ for each material of the color selecting electrode. Thus, there can be obtained a color selecting electrode with a stabilized dimension and hence a cathode-ray tube substantially free from degradation in display characteristics such as color deviation.

The present invention will be described in more detail by way of examples thereof.

Example 1

A color selecting electrode as schematically shown in FIG. 1 was formed for use in a 21-in. cathode-ray tube in the following manner. An aperture grille 4 of the electrode was formed by etching a steel sheet of a nitrogen-containing very low carbon steel (having an average thermal expansion coefficient of 14.1 μm/m/° C. over the temperature range from room temperature to 470° C.). Second supports 3*a*, 3*b* and first supports 2*a*, 2*b* of a frame 1 were both made of SUS403 (13Cr stainless steel having an average thermal expansion coefficient of 11.1 μm/m/° C. over the aforementioned temperature range).

The aperture grille 4 was formed by a cold working assuring a large working ratio to set both its yield stress and tensile strength to about 80 kg/mm$^2$. The first support 2*a*, 2*b* were formed by cold drawing and finally recrystalization annealing to set its yield stress to just smaller than 30 kg/mm$^2$. The second supports 3*a*, 3*b* were formed by strenghening heat treatment under the following working conditions (a) to (f) to see the results of the strenghtening process. The aperture grille was then welded to the first supports 2*a*, 2*b* with its tension varied as 50 kg/mm$^2$, 45 kg/mm$^2$, 40 kg/mm$^2$ and 35 kg/mm$^2$, followed by a heat treatment as in a conventional manner to complete the color selecting electrode.

As a comparative example an electrode was formed using conventional second supports (made of a cold worked material of chromium molybdenum steel SCM415 having an average thermal expansion coefficient of 12.2 μm/m/° C. over the temperature range from room temperature to 470° C., Rockwell B scale: about 97) with the initial tension at end portions of each grid element being set 50 kg/mm$^2$. Measurement revealed that the final tension at such portions of each grid element was as low as about 25 kg/mm$^2$.

Working conditions:

(a) quenching: heating at 950° C. for 30 minutes then oil cooling;
tempering: heating at 600° C. for an hour then cooling in furnace (cooling in open air when the material was cooled to 400° C. or below);

(b) quenching: heating at 950° C. for 30 minutes then oil cooling;
tempering: heating at about 650° C. for about an hour then cooling in furnace (cooling in open air when the material was cooled to 400° C. or below);

(c) Quenching: heating at 950° C. for 30 minutes then oil cooling;
tempering: heating at 700° C. for an hour then cooling in furnace (cooling in open air when the material was cooled to 400° C. or below);

(d) no heat treatment after cold working (Rockwell B scale: about 97)

(e) cold working (Rockwell B scale: about 97) then full annealing (heating at 850° C. for an hour then cooling in furnace); and (f) cold working (Rockwell B scale: about 97) then stress relief annealing (heating at 510° C. for an hour then cooling in furnace).

The above conditions except condition (e) brought good results when the initial tension was set to 35 kg/mm$^2$ or higher for assuring the final tension assuming 25 kg/mm$^2$. Since the average thermal expansion coefficient of the second supports over the temperature range from 0° C. to 470° C. was about 79% of that of the grid elements of the aperture grille over the same temperature range, the final tension assuming 25 kg/mm$^2$ was assured even if the initial tension was set to 35 kg/mm$^2$.

From the results any electrode formed using the second supports manufactured under each condition except (e) was found to have no abnormality, while the electrode formed using the second supports manufactured under the condition (e) including full annealing caused compressive yield at the second supports due to the tension of the aperture grille. Therefore, the use of SUS403 for at least the second supports can assure a sufficient strength for the electrode even if the second supports are manufactured under any of the aforementioned conditions except the condition (e).

Although comparison of the condition (f) with the condition (d) was not directly evaluated in this measurement, the condition (f) is considered to bring an effect generally believed of stress relief annealing from the viewpoints of dimensional stability against long-time use and the like.

It should be noted that although the 13Cr stainless steel was used for the second supports, there can be expected substantially the same effect as above if another 13Cr stainless steel, 18Cr stainless steel, SUS410, SUS416, SUS420 series steels, SUS440 series steels, SUS430 series steels or the like are used for the second supports. Of these materials, ferrite-type materials should be worked by cold working only, while martensite-type materials may be worked by quenching and tempering as well as by cold working.

Example 2

A color selecting electrode as schematically shown in FIG. 1 was formed for use in a 21-in. cathode-ray tube with the use of the following materials. An aperture grille 4 of the electrode was formed by cold working and etching a steel sheet of a conventionally used nitrogen-containing very low carbon steel. First supports 2*a*, 2*b* were made of annealed SUS403.

Second supports 3*a*, 3*b* of a frame of the electrode were formed by cold working Invar (Fe-36Ni having an average thermal expansion coefficient of about 7.5 μm/m/° C. over the temperature range from 0° C. to 470° C.) which was different from the material used for the second supports of Example 1. The aperture grille was made to stretchedly bridge over the frame to complete the color selecting electrode. The welding of the aperture grille to the first supports 2*a*, 2*b* was performed without any trouble as in a conventional manner.

When the initial tension of the aperture grille was varied stepwise by about 5 kg/mm$^2$ from 50 kg/mm$^2$, the initial tension required to assure the final tension assuming 25 kg/mm$^2$ was found to be as low as 30 kg/mm$^2$ or higher. As a result, there was obtained an aperture having a stabilized tension with little variation of tension even if undergoing heat processes.

As a comparative example an electrode was formed using conventional second supports made of chromium molybdenum steel. Like the comparative example of Example 1, this comparative example had to set its initial tension at end portions of each grid element to 50 kg/mm$^2$ to assure the final tension assuming about 25 kg/mm$^2$.

It should be noted that although Example 2 used Invar for the second supports, the use of an Fe—Ni alloy having 31 to 47 atomic percent of Ni such as 42 alloy for the second supports can be expected to bring substantially the same effect as in Example 2 since the average thermal expansion coefficient of the Fe—Ni alloy over the range up to the temperature for the heat processes is substantially equal to that of Invar (refer to, for example, E. L. Franz, "Metals Handbook", 10th edition, Vol. 2, pp. 889–896).

Example 3

A color selecting electrode was formed as having first support 2*a*, 2*b* and second supports 3*a*, 3*b* both made of Invar and an aperture grille of a nitrogen-containing very low Carbon steel, each of the materials being cold worked.

In this Example the average thermal expansion coefficient of the second supports over the temperature range from 0° C. to 470° C. was about 53% of that of the grid elements, and the required final tension of 25 kg/mm$^2$ was assured with the initial tension set to 30 kg/mm$^2$. This color selecting electrode was found to be of high performance, assuring a stabilized tension with little relaxation while very effectively inhibiting the color deviation due to a transversal (orthogonal to grid elements) move of grid elements.

Example 4

A color selecting electrode was formed as having first support 2*a*, 2*b* made of 42 alloy, second supports of a conventionally used chromium molybdenum steel and an aperture grille of a nitrogen-containing very low carbon steel, each of the materials being cold worked.

Performance test revealed that a cathode-ray tube using this electrode exhibited very little color deviation. It should be noted that the use of Invar only for the first supports 2*a*, 2*b* instead of 42 alloy is expected to bring a further effect of inhibiting the color deviation.

Example 5

A color selecting electrode was formed with conventionally used materials which were manufactured in a conventional manner except that the aperture grille was made of Invar. When the electrode with the initial tension set to 50 kg/mm$^2$ as in a conventional electrode was subjected to a blackening (heat process), some grid elements of the electrode were fractured.

The electrode with the initial tension set to 10 kg/mm$^2$ (or about ⅕ of the conventional initial tension of 50 kg/mm$^2$) was found to exhibit no abnormality in its aperture grille and the final tension assuming 9 kg/mm$^2$. Performance test revealed that the electrode was capable of sufficiently absorbing a thermal expansion of the aperture grille in operation since the expansion was small and that a cathode-ray tube using this electrode exhibited very high performance with little color deviation.

Example 6

A color selecting electrode was formed as having an aperture grille and second supports of a frame both made of Invar and first supports made of SUS403, each of the materials being cold worked.

In this Example the thermal expansion coefficient of the grid elements was equal to that of the second supports and, hence, the initial tension was not varied even after the electrode was subjected to a heat process at a temperature as high as 470° C. When the initial tension was set relatively low, reduced relaxation was assured.

The electrode with the initial tension set to 12 kg/mm$^2$ was found to exhibit no abnormality in its aperture grille and the final tension assuming 11 kg/mm$^2$. Performance test revealed that a cathode-ray tube using this electrode exhibited a highly inhibited color deviation since a thermal expansion appearing when the electrode was in operation was small enough to be abosorbed.

The same held true for an electrode having an aperture grille and second supports 3*a*, 3*b* both made of 42 alloy instead of Invar with the initial tension set to 25 kg/mm$^2$ (final tension: 22 kg/mm$^2$).

Example 7

A color selecting electrode was formed in the same manner as in Example 6 except that its aperture grille was made of 42 alloy and its second supports made of Invar.

Like Example 6, the electrode with the initial tension set to 12 kg/mm$^2$ was found to exhibited no abnormality in its aperture grille. Performance test revealed that a cathode-ray tube using this electrode exhibited a highly inhibited color deviation.

It should be noted that although, Example 7 used 42 alloy for the aperture grille, the use of an Fe—Ni alloy having 31 atomic percent of Ni for the aperture grille can be expected to bring substantially the same effect as in Example 7 since that Fe—Ni alloy has an average thermal expansion coefficient of 6.0 μm/m/° C. over the temperature range from 0° C. to 100° C., which is substantially equal to that of 42 alloy. That alloy contains Ni than Invar or 42 alloy, which saves expensive Ni.

As has been described, according to the present invention the average thermal expansion coefficient of the second supports of the frame over the temperature range from 0° C. to 470° C. is set equal to or lower than 85% of that of the grid elements over the same temperature range; hence, a decrease in the tension of the aperture grille during a heat process is substantially reduced thereby giving a color selecting electrode for cathode-ray tube with a stabilized tension. This leads to a highly reliable cathode-ray tube.

Further, for the first supports of the frame is used a material selected as having an average thermal expansion coefficient of 6 μm/m/° C. or lower over the temperature range from 0° C. to 100° C. This results in a considerable reduction in an outward move of grid elements due to a rise in temperature under the operating conditions for the electrode. Thus, there can be obtained a cathode-ray tube exhibiting a further improved display performance with little color deviation.

Still further, the use of a material having an average thermal expansion coefficient of 6 μm/m/° C. or lower over the temperature range from 0° C. to 100° C. for the grid elements makes it possible to minimize the expansion of grid elements in their stretching direction and hence to set the initial tension of the grid elements to a minimized value. In addition, since the tension of the grid elements can be set low, a decrease in such tension (relaxation) due to a heat process at a high temperature can also be reduced. This leads to a color selecting electrode achieving a stabilized tension and allowing a facilitated operation of stretchedly bridging the aperture grille thereof.

While only certain presently preferred embodiments have been described in detail, as will be apparent with those familiar with the art, certain changes and modifications can be made without departing from the spirit and scope of the invention as defined by the following claims.

What is claimed is:

1. A color selecting electrode for use in a cathode-ray tube, comprising a frame having a pair of opposed first supports and a pair of opposed second supports extending in a direction such as to cross the pair of first supports, and grid elements arranged on the pair of first supports at a fixed pitch and stretchedly bridging the pair of first supports, wherein the pair of second supports and the grid elements are, respectively, made of materials selected such that a mean coefficient of thermal expansion in a temperature range from 0° C. to 470° C. of the pair of second supports is not greater than 85% of that of the grid elements over the same temperature range.

2. The color selecting electrode of claim 1, wherein said pair of second supports and said grid elements are, respectively, made of materials selected such that the mean coefficient of thermal expansion of said pair of second supports is not greater than 70% of that of said grid elements.

3. The color selecting electrode of 1, wherein said pair of first supports are made of a material having a mean coefficient of thermal expansion in a temperature range from 0° C. to 100° C. of not greater than 6 μm/m/° C.

4. The color selecting electrode of 2, wherein said pair of first supports are made of a material having a mean coefficient of thermal expansion in a temperature range from 0° C. to 100° C. of not greater than 6 μm/m/° C.

5. A color selecting electrode for use in a cathode-ray tube, comprising a frame having a pair of opposed first supports and a pair of opposed second supports extending in a direction such as to cross the pair of first supports, and grid elements arranged on the pair of first supports at a fixed pitch and stretchedly bridging the pair of first supports, wherein the pair of first supports of the frame are made of a material having a mean coefficient of thermal expansion in a temperature range from 0° C. to 100° C. of not greater than 6 m/m/° C.

6. A color selecting electrode for use in a cathode-ray tube, comprising a frame having a pair of opposed first supports and a pair of opposed second supports extending in a direction such as to cross the pair of first supports, and grid elements disposed on the pair of first supports at a fixed pitch and stretchedly bridging the pair of first supports, wherein the grid elements are made of a material having a mean coefficient of thermal expansion in a temperature range from 0° C. to 100° C. of not greater than 6 μm/m/° C.

* * * * *

UNITED STATES PATENT AND TRADEMARK OFFICE

CERTIFICATE OF CORRECTION

PATENT NO. : 5,488,263

DATED : January 30, 1996

INVENTOR(S) : Taketoshi TAKEMURA et al

It is certified that error appears in the above-indentified patent and that said Letters Patent is hereby corrected as shown below:

In Column 1, line 17, after "a", insert -- pair --.

In Column 1, line 58, delete "bleckening" and insert -- blackening --.

In Column 1, line 61, delete "bleckening" and insert -- blackening --.

In Column 4, line 18, delete "$\theta$" and insert -- $\sigma$ --.

In Column 4, line 21, delete "$\theta$" and insert -- $\sigma$ --.

In Column 4, line 25, delete "$\theta$" and insert -- $\sigma$ --.

In Column 4, line 30, delete "$\theta$" (both occurrences) and insert -- $\sigma$ -- (both occurrences).

In Column 4, line 37, delete "$\theta$" and insert -- $\sigma$ --.

In Column 4, line 38, delete "$\theta$" and insert -- $\sigma$ --.

In Column 4, line 39, delete "$\theta$" and insert -- $\sigma$ --.

In Column 4, line 40, delete "$\theta$" (both occurrences) and insert -- $\sigma$ -- (both occurrences).

In Column 5, line 54, delete "min." and insert -- mm --.

In Column 6, line 5, delete "$\theta$" and insert -- $\sigma$ --.

In Column 6, line 7, delete "$\theta$" and insert -- $\sigma$ --.

In Column 6, line 14, delete "$\theta$" and insert -- $\sigma$ --.

In Column 6, line 63, delete "bleckening" and insert -- blackening --.

In Column 15, line 6, after "of" insert -- claim --.

UNITED STATES PATENT AND TRADEMARK OFFICE

CERTIFICATE OF CORRECTION

PATENT NO. : 5,488,263

DATED : January 30, 1996

INVENTOR(S) : Taketoshi TAKEMURA et al

It is certified that error appears in the above-indentified patent and that said Letters Patent is hereby corrected as shown below:

In Column 15, line 10, after "of" (first occurrence) insert —claim—.

Signed and Sealed this

Twenty-fourth Day of September, 1996

Bruce Lehman

*Attest:*

BRUCE LEHMAN

*Attesting Officer*

*Commissioner of Patents and Trademarks*